US005688000A

United States Patent [19]

Dolman

[11] Patent Number: 5,688,000

[45] Date of Patent: Nov. 18, 1997

[54] SHOOT BOLT MECHANISM

[75] Inventor: Terence J. Dolman, West Midlands, United Kingdom

[73] Assignee: Feneseal Limited, Tipton, United Kingdom

[21] Appl. No.: 592,326

[22] PCT Filed: Jul. 26, 1994

[86] PCT No.: PCT/GB94/01601

§ 371 Date: Jan. 19, 1996

§ 102(e) Date: Jan. 19, 1996

[87] PCT Pub. No.: WO95/03463

PCT Pub. Date: Feb. 2, 1995

[30] Foreign Application Priority Data

Jul. 26, 1993 [GB] United Kingdom ..... 9315438

[51] Int. Cl.[6] ..... E05C 9/16

[52] U.S. Cl. ..... 292/34; 292/36; 292/DIG. 64

[58] Field of Search ..... 292/34, 36, DIG. 64; 70/118

[56] References Cited

U.S. PATENT DOCUMENTS

| | | | |
|---|---|---|---|
| 958,880 | 5/1910 | Lawson | 292/36 X |
| 1,621,740 | 3/1927 | Pavola | 292/36 X |
| 1,670,277 | 5/1928 | Albach | 70/118 |
| 1,895,630 | 1/1933 | Kemp . | |

FOREIGN PATENT DOCUMENTS

| | | | |
|---|---|---|---|
| 0542694 | 5/1993 | European Pat. Off. . | |
| 956032 | 1/1950 | France . | |
| 1303964 | 8/1962 | France . | |
| 362960 | 11/1922 | Germany . | |
| 377163 | 6/1923 | Germany . | |
| 3642783 | 6/1987 | Germany . | |
| 2629508 | 10/1989 | Germany . | |
| 9300547 | 3/1993 | Germany . | |
| 72137 | 6/1931 | Sweden | 292/36 |
| 1143747 | 2/1969 | United Kingdom . | |
| 2115055 | 9/1983 | United Kingdom . | |

*Primary Examiner*—Rodney M. Lindsey
*Attorney, Agent, or Firm*—Leydig, Voit & Mayer, LTD.

[57] ABSTRACT

A shoot bolt mechanism includes a casing having a front wall and a rear wall. The casing contains a shoot bolt having opposed ends and slidable between an inoperative and an operative position. A rotatable drive member is mounted in the casing adjacent the casing rear wall. A link is pivotally connected at one end to the shoot bolt and at another end to the drive member at a point eccentric from an axis of rotation of the drive member. Rotation of the drive member is translated by the link into movement of the shoot bolt between retracted and extended positions. Two drive transfer members are disposed on respective opposite sides of the shoot bolt between opposed ends thereof when the shoot bolt is in the retracted position. Rotation of the drive member moves the drive transfer members between respective retracted and extended positions in directions generally normal to the direction of movement of the shoot bolt between its retracted and extended positions.

17 Claims, 3 Drawing Sheets

SHOOT BOLT MECHANISM

BACKGROUND OF THE INVENTION

The invention relates to shoot bolt mechanisms.

Such mechanisms are mounted on a moveable frame, particularly a window frame, and include at least one shoot bolt which is moveable by, for example, operation of a handle, from an inoperative position to an operative position in which the shoot bolt engages a fixed frame to lock the moveable frame to the fixed frame.

The mechanism may also include two further shoot bolts carried on the moveable frame at locations remote from the mechanism and moved by the mechanism, via shoot bolt rods between inoperative positions and operative positions in which they engage the fixed frame.

In windows, in particular, where the moveable frame may be formed by thin membranes, there is a requirement for a shoot bolt mechanism that is as compact as possible given the requirement for a fixed throw of the shoot bolt (i.e. the distance moved by the shoot bolt between the inoperative and operative positions).

SUMMARY OF THE INVENTION

According to the invention, there is provided a shoot bolt mechanism comprising a casing containing a shoot bolt slidable between an inoperative position and an operative position, a rotatable drive member mounted in the casing and a link pivotally connected at one end to the shoot bolt and at an end opposite said one end to a point on the boss eccentric from the axis of rotation thereof, said pivot axes being parallel to the axis of rotation of the drive member so that rotation of the drive member is translated by the link into movement of the shoot bolt between said retracted and extended positions.

Such a mechanism can be very compact.

The drive member may comprise a boss including a lug projecting therefrom, the lug including said pivotal connection with the link.

Preferably, the drive member includes an exterior surface of circular cross-section, the link including an inner edge having a curvature generally equal to the curvature of said circular cross-section, said inner edge embracing the exterior surface of the drive member when the shoot bolt is in the inoperative position.

Where the drive member includes an exterior surface of circular cross-section, the link may include an outer edge having a curvature generally equal to the curvature of said circular cross-section, the shoot bolt including an inner recess having a corresponding curvature so that, when the shoot bolt is in the inoperative position, the curved outer edge of the link is received in said recess.

When the shoot bolt is in the inoperative position, the axes of the pivotal connections of the link may lie on an imaginary arc having a centre on the axis of the drive member and subtending an angle of 90° relative to the drive member axis.

When the shoot bolt is in the operative position, the axes of the pivotal connections of the link and the axis of the drive member may lie on an imaginary straight line extending in the same direction as the direction of movement of the shoot bolt.

In this case the drive member preferably rotates through 90° to move said bolt between the inoperative and operative positions.

Preferably the shoot bolt is constrained by the casing to rectilinear movement between said inoperative and operative positions.

The mechanism may further comprise two drive transfer members disposed-on respective opposite sides of the shoot bolt, rotation of said drive member moving the drive transfer members between respective retracted and extended positions.

The shoot bolt may be linked to the two drive transfer members so that movement of said shoot bolt between the inoperative and operative positions causes movement of the drive transfer members between the retracted and extended positions and movement of the shoot bolt between the operative and inoperative positions causes movement of the drive transfer members between the extended and retracted positions.

The linkage between the shoot bolt and each drive transfer member may comprise a pin engaging in an angled slot so that movement of the pin in one direction produces a force in a direction normal to said direction of pin movement.

Each pin may be carried on the shoot bolt with each angled slot formed on an associated one of the drive transfer members.

Each drive transfer member preferably includes a connector for connecting the drive transfer member to a shoot bolt rod for moving a respective further shoot bolt remote from the mechanism between inoperative and operative positions in accordance with the retracted and extended positions of the associated drive transfer member.

Each connector may include an aperture and a pair of-spaced spring limbs extending across the aperture on respective opposite sides thereof.

Each drive transfer member preferably includes two side-by-side apertures, the spring limbs for the two apertures being provided by an H-shaped spring clip, one pair of limbs of the H-shaped clip projecting into one aperture and the other pair of limbs of the H-shaped clip projecting into the other aperture.

The mechanism may further comprise two shoot bolt rods, each rod having a further shoot bolt at one end thereof and a coupling at an end thereof opposite said one end, each coupling being engaged with a connector of an associated one of the drive transfer members.

Each coupling may be disengageable from the associated connector.

Each coupling preferably comprises a mushroom-shaped head, with a stem of the head having two opposite flats whose ends are connected by curved portions having the safe diameter of the head, the spring limbs, when the coupling engages the connector with the head inserted in the connector aperture, engaging behind the head with respective flats, rotation of the coupling causing the curved portions to spring the limbs apart and allow said disengagement.

DESCRIPTION OF PREFERRED EMBODIMENTS

Figure 1:
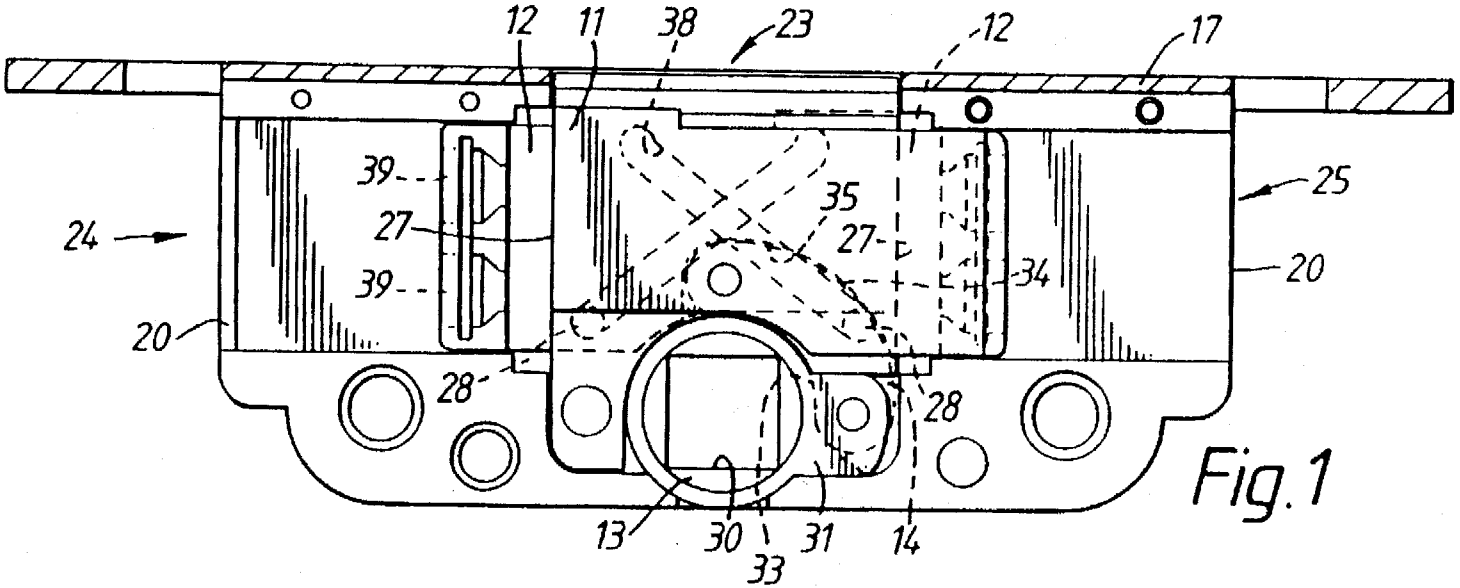
FIG. 1 is a side elevation of a shoot bolt mechanism with a side wall of a casing of the mechanism removed to show the parts within the casing, a shoot bolt of the mechanism being in an inoperative retracted position.

Referring to the drawings, the principle components of the shoot bolt mechanism are two casing halves 10, a shoot bolt 11, two drive transfer members 12, a drive member 13, a link 14, and two shoot bolt rods 15.

Figure 2:
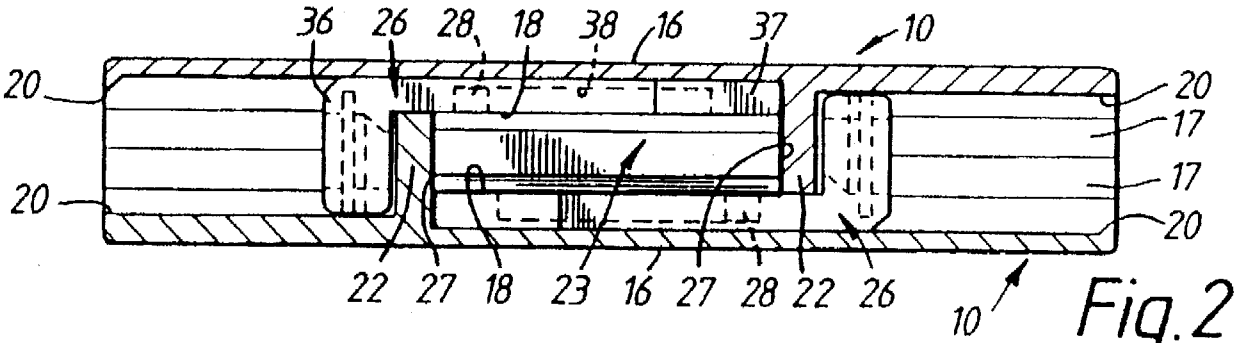
FIG. 2 is a plan view from above of the mechanism of FIG. 1 in the disposition shown in FIG. 1 and with a front wall of the casing removed.
Figure 3:
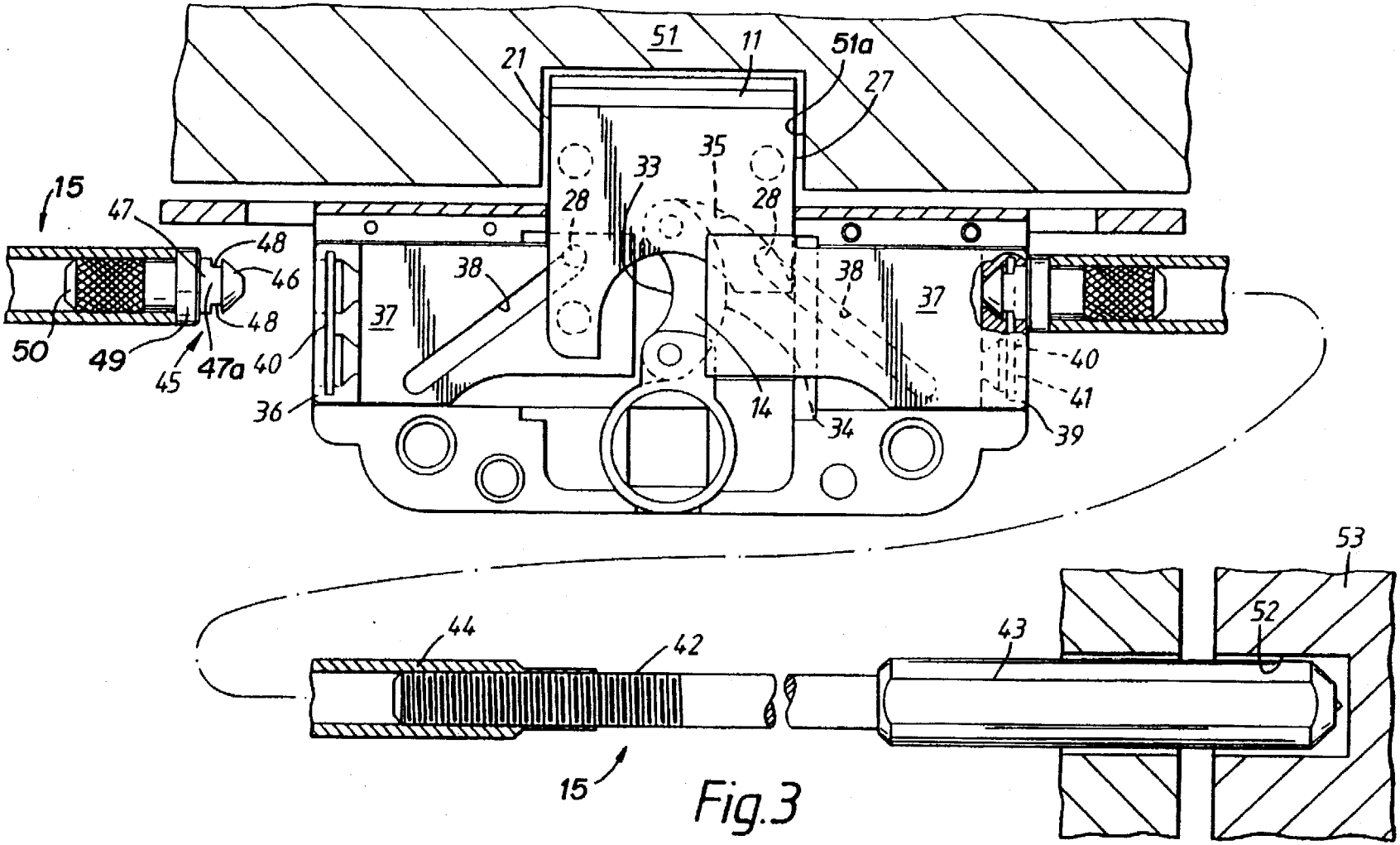
FIG. 3 is a similar view to FIG. 1 but showing the bolt in an operative projecting position and showing two shoot bolt rods, one of which is connected to the mechanism.
Figure 4:
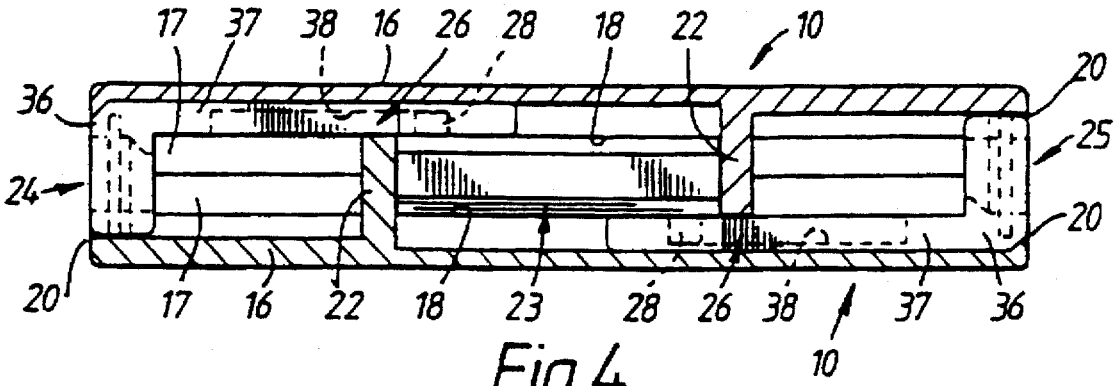
FIG. 4 is a plan view from above of the mechanism of FIGS. 1 to 3 in the disposition shown in FIG. 2 and with a front wall of the casing removed.
Figure 5:
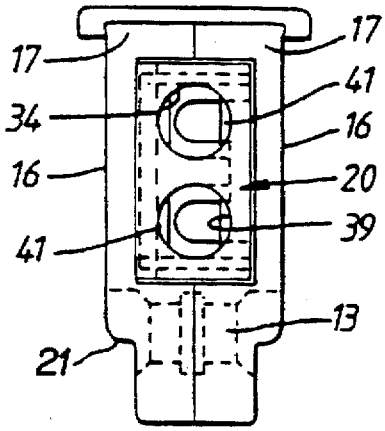
FIG. 5 is an elevation of a side of the casing.
Figure 6:
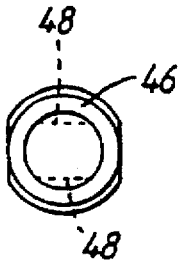
FIG. 6 is an end elevation of a shoot bolt rod.

The casing halves 10 are identical. As best seen in FIGS. 2, 3 and 4, each casing half has a generally rectangular side wall 16 provided with a continuous flange 17 extending around the periphery of the side wall 16 and lying in a plane normal to the plane of the side wall 16. The flange 17 is provided with a rectangular cutout 18 along a front edge of the side wall and with rectangular cutouts 20 along each side edge of the side wall 16. An inwardly directed step 21 is formed towards the rear edge of the side wall 16. As seen in FIGS. 2 and 4, each side wall 16 also has a rib 22 lying in a plane normal to the plane of the side wall 16 and extending between the front edge and the rear edge of the side wall 16. The rib 22 is located about a third of the distance between the two side edges of the side wall 16.

When one casing half 10 is reversed and placed with its flange 17 in contact with the flange 17 of the other casing half 10, a whole casing is formed which, as best seen in FIGS. 3 and 4, has a continous peripheral wall interrupted at the front edge by a rectangular slot 23 (formed by the cut-outs 18) and at its side edges by second and third rectangular slots 24,25 (formed by the cut-outs 20). As seen in FIG. 3, each rib 22 terminates at its free end at a position spaced from the side wall 16 of the other casing half to form respective gap 26.

The shoot bolt 11, as seen in FIGS. 1, 2 and 3, is formed by a metal block which is generally rectangular in plan and section. The shoot bolt 11 has parallel side edges 27 whose spacing is the same as the spacing of the two ribs 22, with the shoot bolt 11 being located between the ribs 22 so that the ribs 22 form a channel which guides the shoot bolt 11 in sliding movement. The first slot 23 has the same cross-section as the shoot bolt 11 and is aligned with the gap between the ribs 22, as seen in FIG. 3. The shoot bolt 11 can thus slide between the position shown in FIG. 1 in which it is retracted within a casing and the position shown in FIG. 3 in which it projects from the casing through the first slot 23. As seen in FIGS. 2 and 4, the shoot bolt 11 carries two pins 28 projecting from respective opposite faces of the shoot bolt and located towards respective opposite side edges 27 of the shoot bolt 11.

The drive member comprises a boss 13 which has an outer surface of circular cross-section by which the boss is mounted for rotation in apertures 29 formed in the side waLls 16 of the casing halves 10. The axis of rotation of the boss 13 is thus normal to the direction of movement of the shoot bolt 11. The interior of the boss 13 is provided with a rectangular section bore 30 for receiving a drive rod (not shown) to whose ends respective handles can be attached to rotate the drive bar and thus rotate the boss 13.

The exterior surface of the boss is provided with a lug 31 which extends in a direction normal to the rotational axis of the boss 13. The link 14 is curved and is pivotally connected at one end to the lug 31 and pivotally connected at the other-end to the shoot bolt 11. The axes of the pivotal connections are parallel to the axis of rotation of the boss 11.

As seen in FIG. 1, the boss 13 is located as close as possible to the rear wall of the casing. As also seen in this Figure, when the shoot bolt 11 is in the retracted position, the lug 31 is also adjacent this rear wall and the link 14 is disposed about the exterior surface of the boss 13; the curvature of the inner edge 33 of the link 14 matching the curvature of the exterior surface of the boss 13. The outer edge 34 of the link 14 lies adjacent a correspondingly curved recess 35 in the shoot bolt 11. In this position, the axes of the pivotal connections of the link 14 lie on an arc whose centre is co-axial with the axis of rotation of the boss 13 and which subtends an angle of 90° relative to the boss axis.

Each drive transfer member 12 is generally L-shaped, as seen in FIGS. 2 and 4, with a head 36 extending normal to a guide plate 37. As also seen in FIGS. 2 and 4, each guide plate 37 fits in a respective gap 26 between an end of a rib 22 and the adjacent side wall 16. The width of the head 36 is generally equal to the spacing between the side walls 16.

In this way, each drive transfer member 12 is held for sliding movement between the extended position shown in FIG. 4 and a retracted position shown in FIG. 2.

Each guide plate is provided with an angled guide slot which receives a respective one of the pins 28 on the shoot bolt 11.

Figure 7:
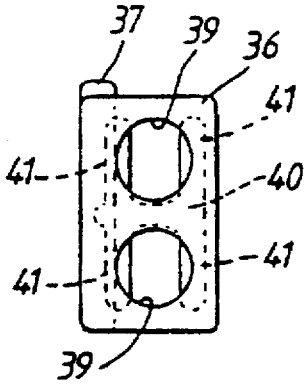
FIG. 7 is a an end elevation of a shoot bolt rod operating member of the mechanism.

The head 36 of each drive transfer member 12 is provided with two spaced holes 39 as best seen in FIG. 7. An H-shaped spring clip 40 is held by the head so that each pair of limbs 41 of the H-shaped clip 40 projects into the circumference of an associates one of the pair of holes 39.

Each shoot bolt rod 15 comprises a rod 42 having a bolt 43 at one end and carrying a tube 44 at the other end. The tube 44 is in threaded engagement with the rod 42 to allow adjustment of the length of the shoot bolt rod 15.

The open end of the tube 44 receives a coupling 45 comprising a mushroom-shaped head 46 whose stem 47 has a pair of parallel flats 48 with curved portions **47*a* between the flats 48 and having a diameter equal to the diameter of the head. The head 46 is carried on a body 49 including projection 50 received in the end of the tube 44 provided with knurling to hold the coupling 45 securely fixed to the tube 44**.

As seen in FIG. 3, each coupling 45 is sized to be insertable in either one of the two holes 39 of a drive transfer member 12. Two holes 39 are provided to allow the shoot bolt rods 15 to be mounted in different configurations. On insertion, the associated limbs 41 of the H-shaped spring clip 40 are sprung apart by the head 46 and then snap back behind the head 46 to engage the flats 48 and hold the coupling 45. Thus the shoot bolt rod 15 connected to the associated drive transfer member 12.

By rotating the coupling 45 by 90°, the flats 48 move out of engagement with the limbs 41 and the curved portions **47*a* of the stem 47 spring the limbs 41 apart, thus allowing the coupling 45 to be disengaged from the associated drive transfer member 12**.

In use, the shoot bolt mechanism is mounted in a movable door or window frame with the shoot bolt 11 opposite an associated keeper **51*a* (FIG. 3) in a fixed frame member 51. The shoot bolt rods 15 are carried by the moveable door or window frame with the bolts 43 arranged opposite associated keepers 52 in a fixed frame member 53. The fixed frame members 53 in which these keepers 52 are mounted are at right angles to the fixed frame member 51 receiving the shoot bolt 11. The shoot bolt rods 15 are connected to the associated drive transfer members 12 by engagement of the couplings 45 with respective holes 39, as seen to the right hand side of FIG. 4**.

Rotation of the boss 13 from the position shown in FIG. 1 causes rotation of the lug 31 about the boss 13. This rotation is transmitted by the link 14 to the shoot bolt 11 which then moves, guided by the ribs 22, from the retracted position shown in FIG. 1 to the extended position shown in FIG. 3.

In doing so, the pins 28 also move along the guide slots 38 and cause the drive transfer members 12 to move from the position shown in FIG. 2 to the position shown in FIG. 4. This moves the shoot bolt rods 15 so moving the bolts 43 from respective retracted positions to respective extended positions in which they engage their respective keepers.

The movement continues until the pins 28 reach the ends of the guide slots 38 and in this position the lug 31 is turned through 90° and the pivot axes of the link 12 and the axis of rotation of the boss 13 lie on a common line which extends in the same direction in the direction of movement of the shoot bolt 11. This provides maximum movement of the shoot bolt 11.

As seen in FIG. 3, when in this position, the shoot bolt 11 engages closely in the associated keeper 50. This resists relative movement between the movable frame and the fixed frame members 53 housing the bolts 43 so resisting unauthorised release of the bolts 43 by, in turn, levering the movable frame away from each of the fixed frame members Reverse rotation of the boss 13 retracts the shoot bolt 11 and also retracts the drive transfer members 12 so retracting the shoot bolt rods 15 and the associated bolts 43.

In this way, the spacing between the front and rear edges of the casing is minimised. The throw of the shoot bolt 11 must be a set distance, for example 18 mm, and so cannot be altered. However, by having the boss 13 as close as possible to the rear wall, by having a drive transfer mechanism (see link 14) that lies around the boss when in the operative position and does not project beyond the rear wall when in the inoperative position, the width is minimised. Connection of the two bolts rods 15 is easy and simple and the transfer of the drive from the shoot bolt 11 to the drive transfer members 12 is uncomplicated and reliable.

What is claimed is:

1. A shoot bolt mechanism comprising a casing having a front wall and a rear wall, the casing containing a shoot bolt having opposed ends and slidable between an inoperative position in which the shoot bolt lies within the casing with one end adjacent the casing rear wall and the other end adjacent the casing front wall and a operative position in which the other end of the shoot bolt projects from the casing front wall, a rotatable drive member mounted in the casing adjacent the casing rear wall and a link pivotally connected at one end to the shoot bolt, and at an end opposite the one end to a point of the drive member, eccentric from an axis of rotation of the drive member, the pivotal connection being adjacent the casing rear wall when the shoot bolt is in the inoperative position, and the pivot axes being parallel to the axis of rotation of the drive member so that rotation of the drive member is translated by the link into movement of the shoot bolt between retracted and extended positions, the pivotal connection of the shoot bolt and the link being adjacent the front wall in the extended position, two drive transfer members being disposed on respective opposite sides of the shoot bolt between opposed ends thereof when the shoot bolt is in the retracted position, rotation of the drive member moving the drive transfer members between respective retracted and extended positions in directions generally normal to the direction of movement of the shoot bolt between its retracted and extended positions.

2. A shoot bolt mechanism according to claim 1 wherein the shoot bolt is linked to the two drive transfer members so that movement of the shoot bolt between the inoperative and operative positions causes movement of the drive transfer members between the retracted and extended positions and movement of the shoot bolt between the operative and inoperative positions causes movement of the drive transfer members between the extended and retracted positions.

3. A shoot bolt mechanism according to claim 2 wherein the linkage between the shoot bolt and each drive transfer member comprises a pin engaging in an angled slot so that movement of the pin in one direction produces a force in a direction normal to the direction of pin movement.

4. A shoot bolt mechanism according to claim 3 wherein each pin is carried on the shoot bolt with each angled slot formed on an associated one of the drive transfer members.

5. A shoot bolt mechanism according to claim 1 wherein each drive transfer member includes a connector for connecting the drive transfer member to a shoot bolt rod for moving a respective further shoot bolt remote from the shoot bolt mechanism between inoperative and operative positions in accordance with the retracted and extended positions of the associated drive transfer member.

6. A shoot bolt mechanism according to claim 5 wherein each connector includes an aperture and a pair of spaced spring limbs extending across the aperture on respective opposite sides thereof.

7. A shoot bolt mechanism according to claim 6 wherein each drive transfer member includes two side-by-side apertures, the spring limbs for the two apertures being provided by an H-shaped spring clip, one pair of limbs of the H-shaped clip projecting into one aperture and the other pair of limbs of the H-shaped clip projecting into the other aperture.

8. A shoot bolt mechanism according to claim 7 further comprising two shoot bolt rods, each rod having a further shoot bolt at one end thereof and a coupling at an end thereof opposite the one end, each coupling being engaged with a connector of an associated one of the drive transfer members.

9. A shoot bolt mechanism according to claim 8 wherein each coupling is disengageable from the associated connector.

10. A shoot bolt mechanism according to claim 8 wherein each coupling comprises a mushroom-shaped head, with a stem of the head having two opposite flats whose ends are connected by curved portions having the same diameter of the head, the spring limbs, when the coupling engages the connector with the head inserted in the connector aperture, engaging behind the head and with respective flats, rotation of the coupling causing the curved portions to spring the limbs apart and allow the disengagement.

11. A shoot bolt mechanism according to claim 1 wherein the drive member comprises a boss including a lug projecting therefrom, the lug including the pivotal connection with the link.

12. A shoot bolt mechanism according to claim 1 wherein the drive member includes an exterior surface of circular cross-section, the link including an inner edge having a curvature generally equal to the curvature of the circular cross-section, the inner edge embracing the exterior surface of the drive member when the shoot bolt is in the inoperative position.

13. A shoot bolt mechanism according to claim 1 wherein the drive member includes an exterior surface of circular cross-section, the link including an outer edge having a curvature generally equal to the curvature of the circular cross-section, the shoot bolt including an inner recess having a corresponding curvature so that, when the shoot bolt is in the inoperative position, the curved outer edge of the link is received in the recess.

14. A shoot bolt mechanism according to claim 1 wherein, when the shoot bolt is in the inoperative position, the axes of the pivotal connections of the link lie on an imaginary arc having a center on the axis of the drive member and subtending an angle of 90° relative to the drive member axis.

15. A shoot bolt mechanism according to claim 1 wherein, when the shoot bolt is in the operative position, the axes of the pivotal connections of the link and the axis of the drive member lie on an imaginary straight line extending in the same direction as the direction of movement of the shoot bolt.

16. A shoot bolt mechanism according to claim 15 wherein the drive member rotates through 90° to move the bolt between the inoperative and operative positions.

17. A shoot bolt mechanism according to claim 1 wherein the shoot bolt is constrained by the casing to rectilinear movement between the inoperative and operative positions.

* * * * *